US006973952B2

(12) United States Patent
Nien

(10) Patent No.: US 6,973,952 B2
(45) Date of Patent: Dec. 13, 2005

(54) ANTI-REVERSE TRANSMISSION APPARATUS AND WINDOW BLIND USING THE SAME

(75) Inventor: Ming Nien, Changhua Hsien (TW)

(73) Assignee: Nien Made Enterprise Co., Ltd., Taichung (TW)

( * ) Notice: Subject to any disclaimer, the term of this patent is extended or adjusted under 35 U.S.C. 154(b) by 21 days.

(21) Appl. No.: 10/642,189

(22) Filed: Aug. 18, 2003

(65) Prior Publication Data

US 2005/0000663 A1 Jan. 6, 2005

(30) Foreign Application Priority Data

Jul. 3, 2003 (TW) ..... 92212282 U

(51) Int. Cl.[7] ..... E06B 9/322
(52) U.S. Cl. ..... 160/170; 160/298; 192/223.4
(58) Field of Search ..... 160/170, 171, 160/173 R, 178.1 R, 298; 192/223.4

(56) References Cited

U.S. PATENT DOCUMENTS 3,194,366 A * 7/1965 Hensel ..... 192/223.2
4,372,432 A * 2/1983 Waine et al. ..... 192/223.4
5,375,643 A * 12/1994 Rude ..... 160/321
5,909,791 A * 6/1999 DiStefano ..... 192/223.4
6,173,754 B1 * 1/2001 DeBlock ..... 160/98
6,173,825 B1 * 1/2001 Liu ..... 192/223.4
6,843,302 B2 * 1/2005 Nijs ..... 160/321
2003/0085003 A1 * 5/2003 Cheng ..... 160/321
2004/0123957 A1 * 7/2004 Wen et al. ..... 160/168.1 R

FOREIGN PATENT DOCUMENTS

FR 2 692 002 12/1993

* cited by examiner

*Primary Examiner*—Blair M. Johnson
(74) *Attorney, Agent, or Firm*—Browdy and Neimark, PLLC

(57) ABSTRACT

An anti-reverse transmission for use in a window blind includes a fixed axle, a rotatable input shaft, an output shaft sleeved onto the fixed axle, a transmission shaft sleeved onto the output shaft and coupled to a linking rod of a window blind, the transmission shaft having a protrusion inserted into an opening in the output shaft, and a spiral spring fitted on the fixed axle within the output shaft. The spiral spring has two end tips suspended in the opening such that the spiral spring is radially expanded to disengage the output shaft from the fixed axle for rotation with the transmission shaft and the input shaft upon rotation of the input shaft, and the spiral spring is radially compressed to stop the output shaft from rotation when the transmission shaft receives a biasing force from the gravity weight of a blind body of the window blind.

16 Claims, 6 Drawing Sheets

ANTI-REVERSE TRANSMISSION APPARATUS AND WINDOW BLIND USING THE SAME

BACKGROUND OF THE INVENTION

1. Field of the Invention

The present invention relates generally to window coverings and, more specifically, to an anti-reverse transmission apparatus for use in a lifting window blind (for example, a Venetian blind, roller blind, etc.) to let the user's biasing force be smoothly transmitted to the linking rod to lift or lower the blind body and, to prohibit reverse transmission of biasing force produced due to the gravity weight of the blind body.

2. Description of the Related Art

A conventional lifting window blind commonly uses a lift cord or string of beads for pulling by the user to control lifting or lowering of the blind body. Because the lift cord or string of beads is exposed to the outside of the blind body, an accident may happen when a child playing with the lift cord or tilt cord for fun.

Various window blinds with hidden cord members have been disclosed, and have appeared on the market. A window blind with hidden cord members, as shown in French Patent FR-2692002, is known comprising a transmission mechanism formed of an input shaft and an output shaft and installed in the headrail of the window blind. The input shaft can be directly rotated by the user (an operation rod may be directly fixedly or detachably connected to the input shaft for operation by the user to rotate the input shaft). The output shaft is driven by the input shaft to rotate a linking rod in the headrail, causing the linking rod to lift or lower the blind body.

In order to lock the blind body in position after each adjustment, a pull cord tension adjustment device may be used to offset the downward gravity weight of the blind body, preventing lowering of the blind body after position adjustment. However, the installation procedure of this structure of pull cord tension adjustment device is complicated. There is known a simple anti-reverse transmission apparatus using a worm and a worm gear to substitute for the aforesaid input shaft and output shaft. Theoretically, the engagement between a worm and a worm gear achieves anti-reverse transmission of a biasing force within a certain condition (the worm can rotate the worm gear with less force, however the worm gear requires a relatively bigger force to rotate the worm). In actual practice, excessively heavy of the component parts of the blind body or size limitation of component parts may affect the reverse transmission prohibition functioning of the transmission mechanism of the worm and worm gear, and the blind body may not be accurately stopped in position after adjusted to the desired elevation, or may slip down when touched by an external force accidentally.

Therefore, it is desirable to provide an anti-reverse transmission apparatus for window coverings that eliminates the aforesaid drawbacks.

SUMMARY OF THE INVENTION

The present invention has been accomplished under the circumstances in view. It is the main object of the present invention to provide an anti-reverse transmission apparatus, for use in a lifting window blind with hidden lift cords for operation by the user to transmit biasing force to the lifting window blind and to further lift or lower the blind body, preventing reverse transmission of biasing force.

It is another object of the present invention to provide a lifting window blind with hidden lift cords, which automatically locks the blind body in position after a position adjustment.

To achieve the above objects of the present invention, the anti-reverse transmission apparatus is used in a window blind having a headrail, a blind body suspended from said headrail, and a linking rod fastened rotatably inside said headrail for lifting or lowering said blind body when said linking rod is actuated to rotate. The anti-reverse transmission apparatus comprises a base frame having a fixed axle; an input shaft rotatably mounted to said base frame and rotatable by an external force; an output shaft having a tubular shaft body rotatably sleeved onto said fixed axle of said base frame and coupled to said input shaft for rotation by said input shaft, the tubular shaft body of said output shaft having an opening in a periphery thereof; a transmission shaft adapted to be axially coupled to said linking rod of the window blind for synchronous rotation, said transmission shaft having a tubular body sleeved onto the tubular shaft body of said output shaft, the tubular body of said transmission shaft having a protrusion projecting from an inside wall thereof and suspended in the opening of the tubular shaft body of said output shaft; and a spiral spring having a spiral spring body, a first end tip extended from a first end of said spiral spring body, and a second end tip extended from a second end of said spiral spring body, the spiral spring body of said spiral spring being fitted onto said fixed axle of said base frame within the tubular shaft body of said output shaft, the first and second end tips of said spiral spring being suspended in the opening of the tubular shaft body of said output shaft at two sides of the protrusion of said transmission shaft and respectively stopped at two opposite side edges of the opening of the tubular shaft body of said output shaft such that said output shaft pushes one end tip of said spiral spring to further radially expand said spiral spring body of said spiral spring when said output shaft is actuated by said input shaft to rotate; when said output shaft is immovable, rotating said transmission shaft causes said protrusion of said transmission shaft to push one end tip of said spiral spring and to further radially compress said spiral spring body of said spiral spring.

DETAILED DESCRIPTION OF THE INVENTION

Figure 1:
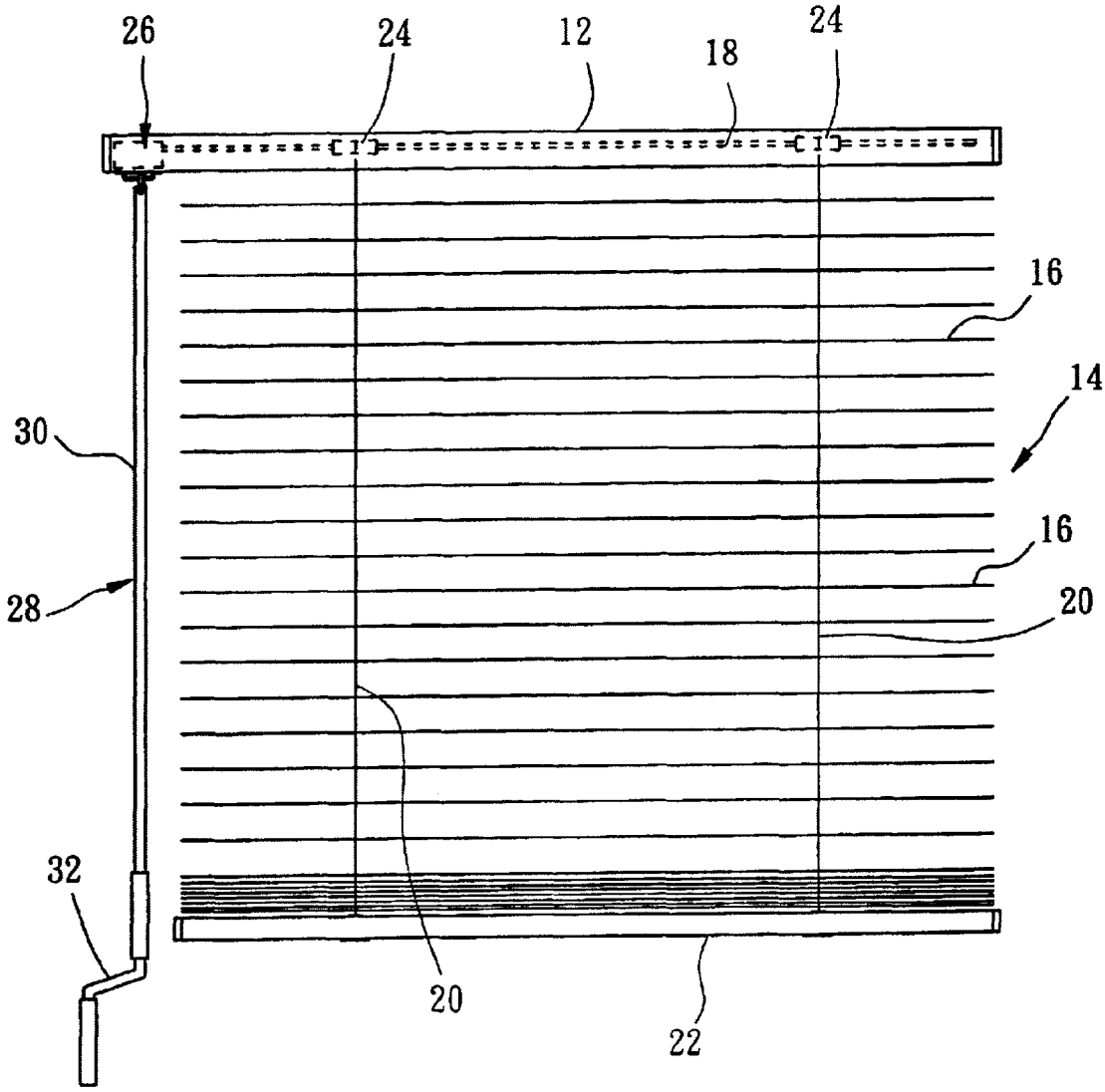
FIG. 1 illustrates a Venetian blind equipped with an anti-reverse transmission apparatus according to a preferred embodiment of the present invention.

An anti-reverse transmission apparatus in accordance with the preferred embodiment of the present invention is to be used in a lifting window blind, for example, a Venetian blind, roller blind, pleated blind, Roman blind, etc. For illustration, FIG. 1 shows a Venetian blind constructed according to the present invention. The Venetian blind 1 comprises a headrail 12, transversely (horizontally) affixed to the top side of the window (not shown), a blind body 14 suspended below the headrail 12 for covering the window and having a bottom rail 22 suspended below the headrail 12 and a set of slats 16 transversely (horizontally) arranged in parallel between the headrail 12 and the bottom rail 22, a linking rod 18 horizontally rotatably mounted in the headrail 12, two lift cords 20 bilaterally longitudinally (vertically) extended through the slats 16, each lift cord 20 having a bottom end affixed to the bottom rail 22 and a top end extended to the inside of the headrail 12 and fastened to the periphery of one bobbin 24 at the linking rod 18, an anti-reverse transmission apparatus 26 mounted in one end of the headrail 12 and adapted to transfer biasing force from its input end toward its output end and to prevent reversing of biasing force from its output end toward its input end, and a control rod 28 for operation by the user to control the status of the Venetian blind. The control rod 28 comprises a straight rod member 30 suspended from the anti-reverse transmission apparatus 26, and a crank 32 coupled to the bottom side of the straight rod member 30 for operation by the user to employ a biasing force to the input end of the anti-reverse transmission apparatus 26.

Figure 2:
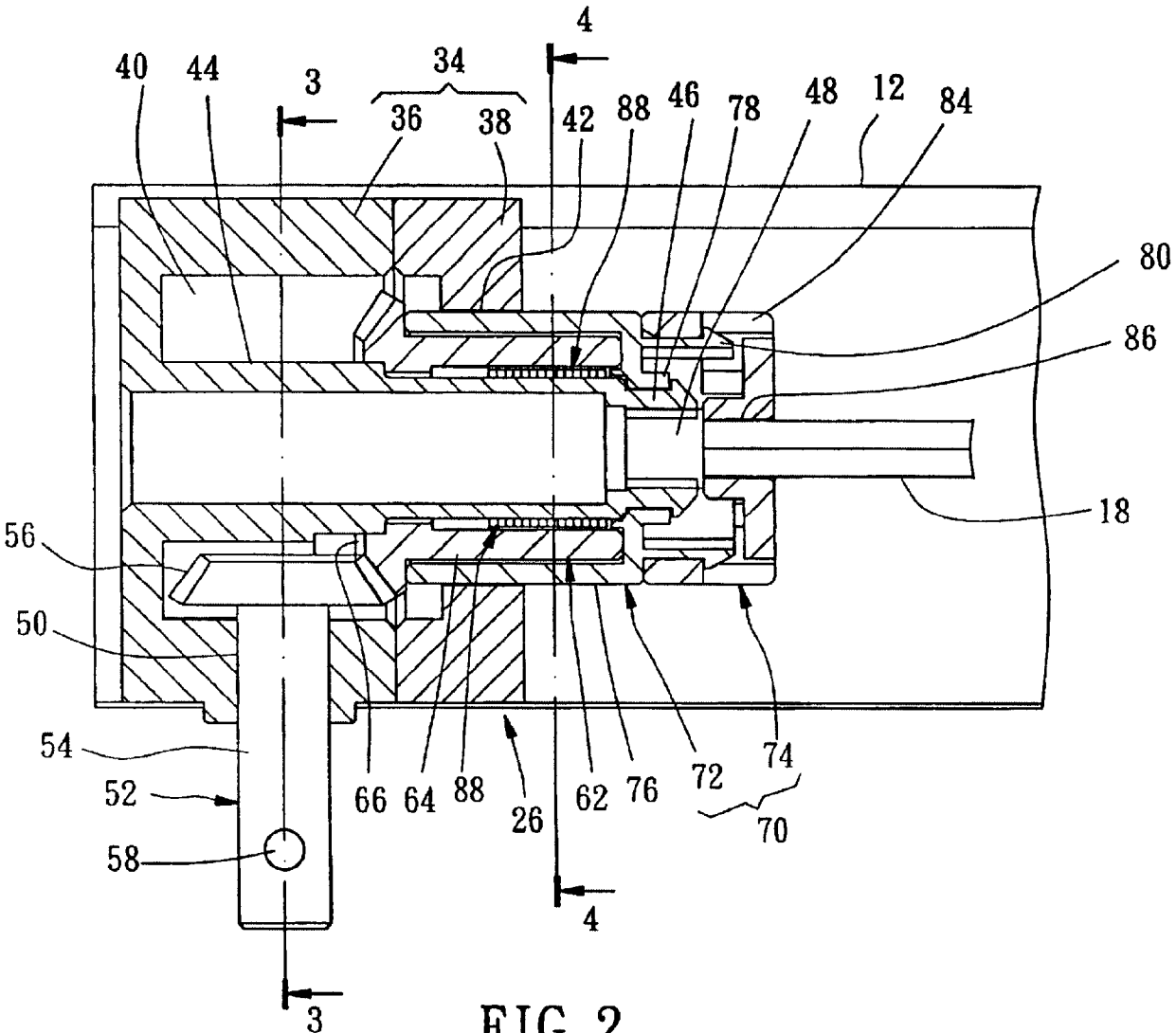
FIG. 2 is a front sectional view of the anti-reverse transmission apparatus according to the preferred embodiment of the present invention.
Figure 3:
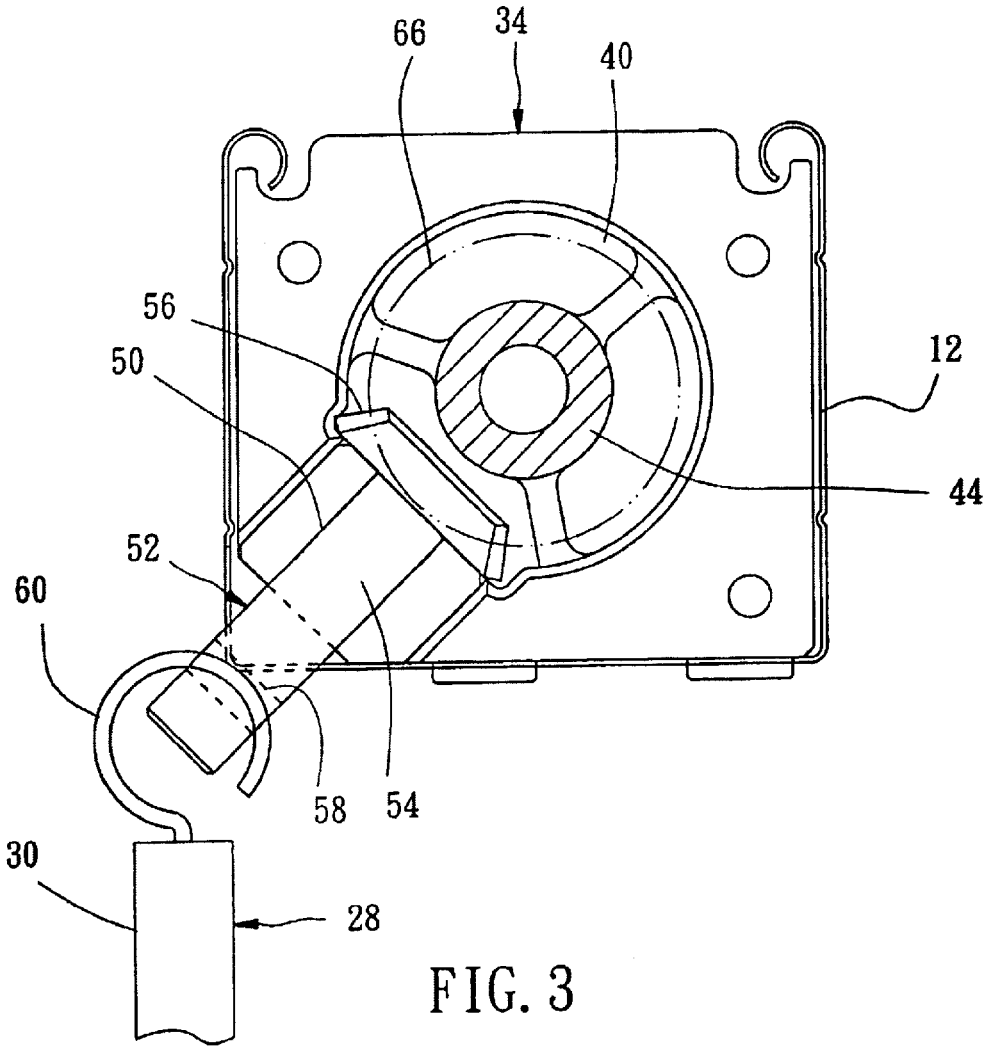
FIG. 3 is a sectional view taken along line 3—3 of FIG. 2.

Referring to FIGS. 2 and 3, the anti-reverse transmission apparatus 26 comprises a base frame 34, an input shaft 52, an output shaft 62, a transmission shaft 70, and two spiral springs 88.

The base frame 34 comprises a main base element 36 and a supplementary base element 38 abutted against each other. The base frame 34 has a substantially rectangular cross-section fitted into one end of the headrail 12 (see FIG. 3), a cylindrical receiving chamber 40 disposed near the outer side of the headrail 12 in parallel to the linking rod 18, a circular axle hole 42 axially extended from one end of the cylindrical receiving chamber 40 toward the inner side of the headrail 12, a fixed tubular axle 44 axially suspended in the cylindrical receiving chamber 40 and the circular axle hole 42, and a pivot hole 50 radially extended from the cylindrical receiving chamber 40 to one corner thereof facing the inside of the house (see FIG. 3). The fixed tubular axle 44 has a neck 46 at the end, and two crevices 48 axially extended through the neck 46 at two sides. The neck 46 has a beveled end edge.

The input shaft 52 is comprised of a shaft body 54 and a bevel gear 56 at one end of the shaft body 54. The shaft body 54 is pivoted to the pivot hole 50 of the base frame 34, keeping the bevel gear 56 suspended in the cylindrical receiving hole 40. The bottom end of the shaft body 54 extends to the outside of the base frame 34 and the headrail 12 and obliquely downwardly aims at the inside of the house. The shaft body 54 has a transverse through hole 58 near the bottom end. The aforesaid straight rod member 30 of the control rod 28 has a top hook 60 hooked in the through hole 58 of the shaft body 54. Therefore, the control rod 28 is detachably pivotally coupled to the input shaft 52 and can be operated by the user to rotate the input shaft 52.

Figure 10:
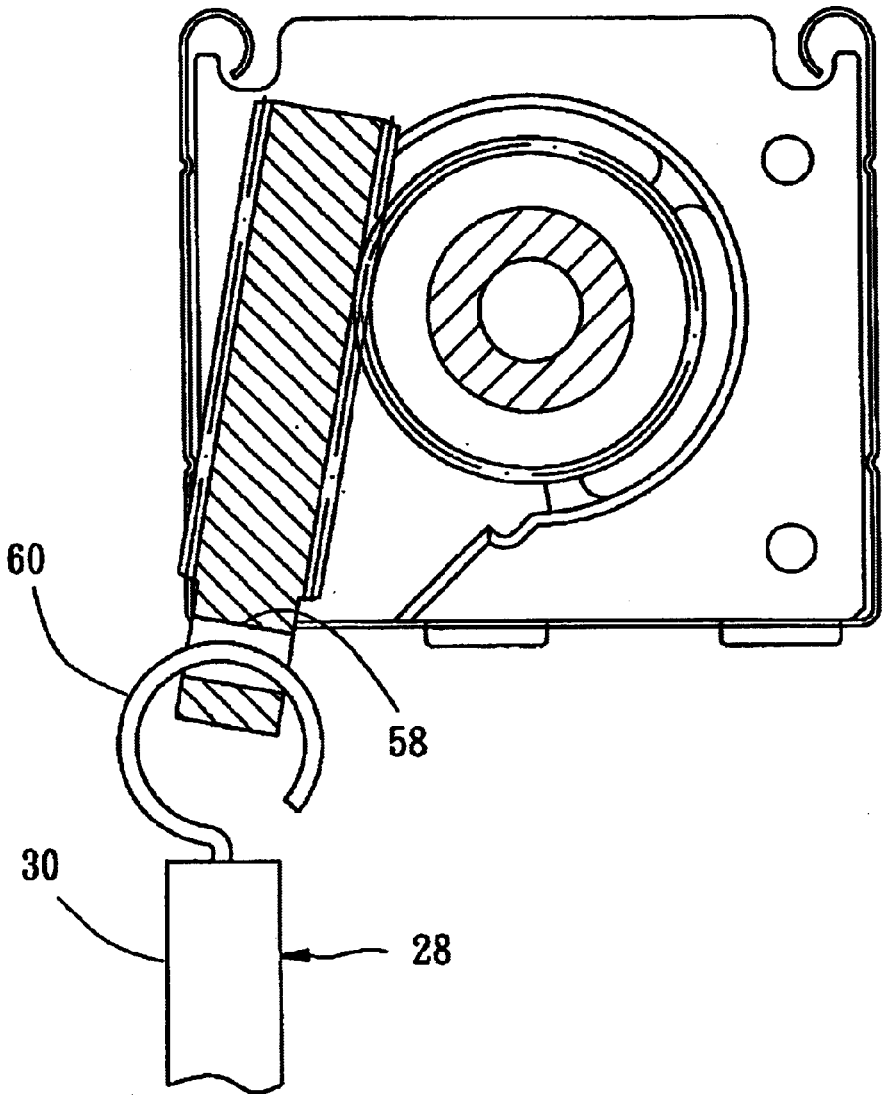
FIG. 10 is a view of the alternative worm and worm screw drive system.

The output shaft 62 is comprised of a tubular shaft body 64 and a bevel gear 66 at one end of the tubular shaft body 64. The tubular shaft body 64 is sleeved onto the fixed tubular axle 44 of the base frame 34, keeping the bevel gear 66 meshed with the bevel gear 56 of the input shaft 52 in the cylindrical receiving chamber 40 of the base frame 34. According to this embodiment, the number of teeth of the bevel gear 56 of the input shaft 52 is less than the bevel gear 66 of the output shaft 62. Therefore, the input shaft 52 and the output shaft 62 reduce the speed of inputted biasing force but enhance the torque. The tubular shaft body 64 of the output shaft 62 has a 90° sector opening 68 in the periphery (see FIG. 4). The bevel gear arrangement may be replaced with an equivalent and known worm and worm gear arrangement, as shown in FIG. 10.

Figure 5:
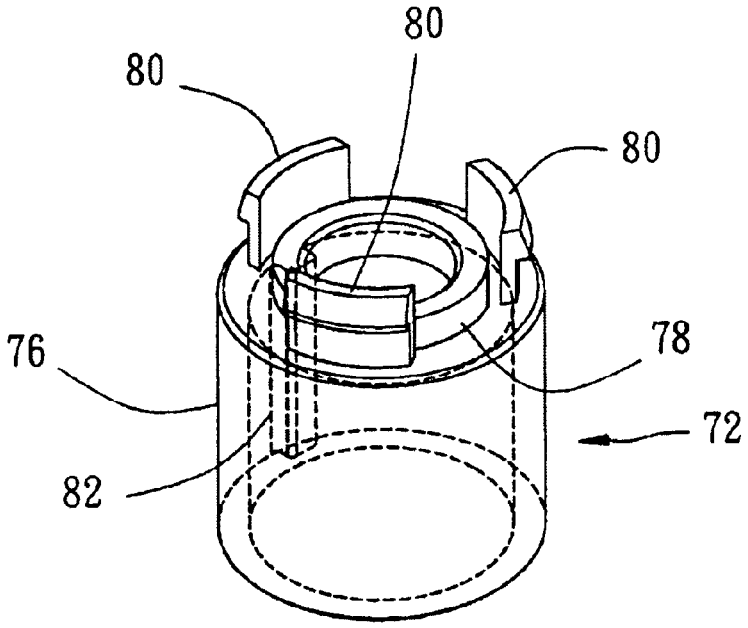
FIG. 5 is a perspective view of the shaft member for the transmission shaft of the anti-reverse transmission apparatus according to the preferred embodiment of the present invention.
Figure 6:
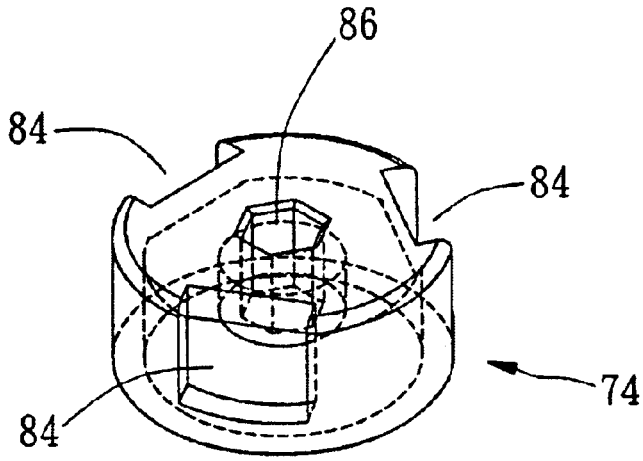
FIG. 6 is a perspective view of the coupling member for the transmission shaft of the anti-reverse transmission apparatus according to the preferred embodiment of the present invention.

The transmission shaft 70 is comprised of a shaft member 72 (see FIG. 5), and a coupling member 74 (see FIG. 6). The shaft member 72 comprises a tubular body 76, a bush 78 in one end of the body 76 and three hooks 80 equiangularly spaced and forwardly extended form an end of the tubular body 76. The tubular body 76 has a longitudinal protrusion 82 in the inside wall. The tubular body 76 of the shaft member 72 is sleeved onto the tubular shaft body 64 of the output shaft 62, keeping the periphery in contact with the peripheral wall of the circular axle hole 42 in the base frame 34 and the longitudinal protrusion 82 in the 90° sector opening 68 of the tubular shaft body 64 of the output shaft 62 (see FIG. 4). During installation, the bush 78 of the shaft member 72 is forced over the beveled end edge of the neck 46 to radially compress the fixed tubular axle 44, causing the fixed tubular axle 44 to close the crevices 48, and therefore the bush 78 is mounted on the neck 46 of the fixed tubular axle 44. When installed, the shaft member 72 and the output shaft 62 are rotatably secured to the fixed tubular axle 44.

Further, the coupling member 74 is shaped like a circular box having an axially extended center through hole 86 and three retaining notches 84 equiangularly spaced around the periphery. The cross section of the center through hole 86 fits the cross section of the aforesaid linking rod 18 (for example, both have a hexagonal cross section). The coupling member 74 is coupled to the shaft member 72, keeping the hooks 84 respectively hooked in the retaining notches 84 of the coupling member 74, and therefore the coupling member 74 and the shaft member 72 are fastened together, forming the aforesaid transmission shaft 70. The center through hole 86 of the coupling member 74 is coupled to the linking rod 18, for enabling the transmission shaft 70 and the linking rod 18 to be rotated synchronously.

Figure 4:
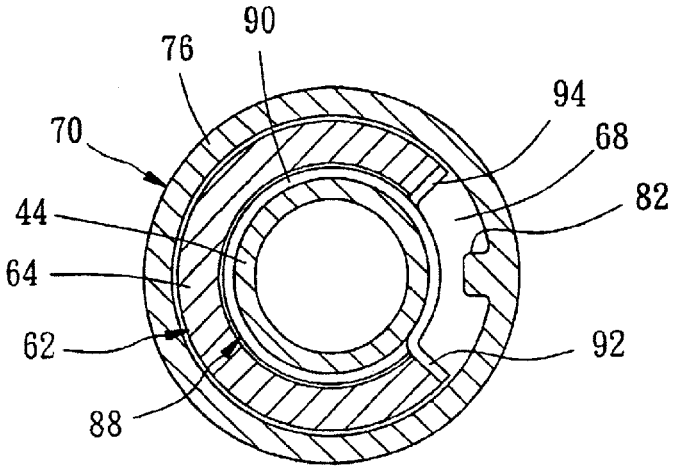
FIG. 4 is a sectional view taken along line 4—4 of FIG. 2.
Figure 7:
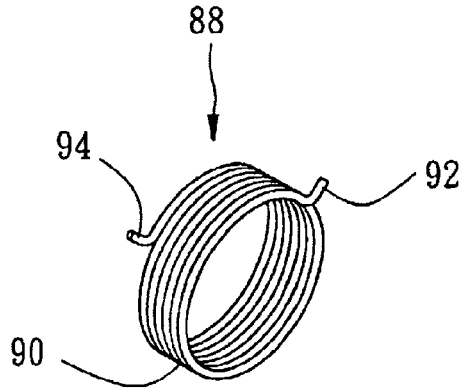
FIG. 7 is a perspective view of a spiral spring for the anti-reverse transmission apparatus according to the preferred embodiment of the present invention.

The two spiral springs 88 each have a spirally extended spring body 90, and two end tips, namely, the first end tip 92 and the second end tip 94 respectively radially extended from the two ends of the spirally extended spring body 90 (see FIG. 7). The two end tips 92 and 94 define a contained angle about 90°. By means of the two spiral springs 88 extend spirally in the same direction, the spirally extended spring bodies 90 of the spiral springs 88 are mounted on the fixed tubular axle 44 of the base frame 34 within the tubular shaft body 64 of the output shaft 62, as shown in FIG. 4, keeping the end tips 92 and 94 suspended in the 90° sector opening 68 of the tubular shaft body 64 of the output shaft 62 at two sides of the longitudinal protrusion 82 of the transmission shaft 70. According to this embodiment, the end tips 92 and 94 are respectively stopped at two opposite side edges of the 90° sector opening 68 of the tubular shaft body 64 of the output shaft 62.

Figure 8:
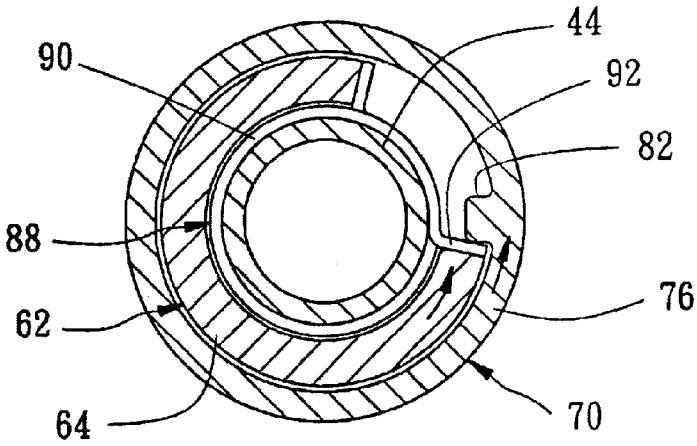
FIG. 8 is similar to FIG. 4 but showing the output shaft rotated.

After description of the detailed structure of the Venetian blind (more particularly the anti-reverse transmission apparatus), the operation of the Venetian blind is outlined hereinafter. When adjusting the status of the Venetian blind, operate the crank 52 of the control rod 28 with the hands to rotate the straight rod 30, causing the straight rod 30 to rotate the input shaft 52 of the anti-reverse transmission apparatus 26. Upon rotary motion of the input shaft 52, the output shaft 62 is rotated synchronously (see FIG. 4). When rotating the output shaft 62, one side edge of the sector opening 68 will be forced against the first end tips 92 or second end tips 94 of the spiral springs 88 (when rotating the output shaft 62 in counter-clockwise direction, one side edge of the sector opening 68 will be forced against the first end tips 92 of the spiral springs 88; on the contrary, when rotating the output shaft 62 in clockwise direction, one side edge of the sector opening 68 will be forced against the second end tips 94 of the spiral springs 88), thereby causing the spiral spring bodies 90 of the spiral springs 88 to be radially expanded and disengaged from the fixed tubular axle 44, for enabling the output shaft 62 to be rotated by the input shaft 52. If the user rotates the output shaft 62 in counter-clockwise direction, as shown in FIG. 8, one side edge of the sector opening 68 will be stopped against the longitudinal protrusion 82 of the transmission shaft 70, thereby causing the transmission shaft 70 to be rotated synchronously. Rotating the transmission shaft 70 causes rotation of the linking rod 18, and therefore the bobbins 24 are rotated with the linking rod 18 to roll up or let off the lift cords 20 and to further receive or open the slats 14, changing the shading status of the Venetian blind.

Figure 9:
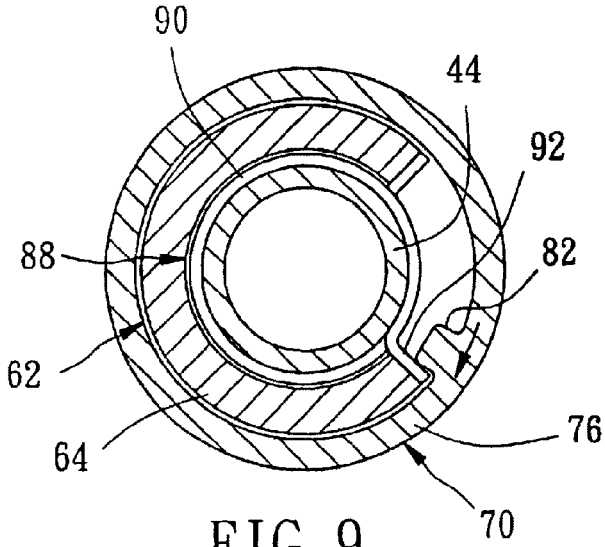
FIG. 9 is similar to FIG. 4 but showing the status where the output shaft is kept immovable and the transmission shaft is to be rotated.

After the Venetian blind has been adjusted to the desired elevation, the user can then release the hands from the operation rod 28. At this time, the gravity weight of the blind body 14 pulls the lift cords 20 downwards to bias the linking rod 18 and the transmission shaft 70. However, please refer to FIG. 9; the longitudinal protrusion 82 is forced against the first end tips 92 of the spiral springs 88 at the beginning of or within a very short time after the rotation of the transmission shaft 70 by the aforesaid biasing force. The situation at this time is reversed, i.e., the longitudinal protrusion 82 of the transmission shaft 70 force the spiral springs 88 to compress on the periphery of the fixed tubular axle 44, stopping the transmission shaft 70 from rotary motion relative to the fixed tubular axle 44, keeping the blind body 14 in position.

As indicated above, after the user adjusted the blind body of the Venetian blind to the desired elevation, the user needs not to take any steps to lock the blind body. When the user released the hands from the operation rod, the input shaft of the anti-reverse transmission apparatus receives no further rotary force from the operation rod, and the blind body of the Venetian blind is automatically locked in the adjusted position. Therefore, the operation of the present invention is easy and, the blind body does not slip down when adjusted. Because the lift cords are hidden in the blind body, the invention eliminates the occurrence of hanging of the lift cords on a person accidentally.

Further, it is to be understood that the input shaft and output shaft of the anti-reverse transmission apparatus convert input biasing force in vertical direction into output biasing force in horizontal direction. A worm and a worm gear may be used for the input shaft and the output shaft respectively to substitute for the bevel gears. The use of worm and worm gear effectively stops reverse transmission of biasing force.

In addition to anti-reverse transmission function, the anti-reverse transmission apparatus further has numerous advantages in space design as follows:

1. Modularized design for quick installation: The anti-reverse transmission apparatus uses a base frame to have the entire related component parts set therein, forming a modularized design for quick installation. During installation, the user needs only to insert the linking rod of the Venetian blind into the anti-reverse transmission apparatus directly. Because the modularized anti-reverse transmission apparatus is detachable, its repair and maintenance work is easy.

2. Compact size: The design of the input shaft enables transmission of biasing force from the vertically extended operation rod to the horizontally extended transmission shaft. Further the bottom end of the input shaft extends to the outside of the base frame for quick connection of the operation rod.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An anti-reverse transmission apparatus for use in a window blind having a headrail, a blind body suspended from said headrail, and a linking rod fastened rotatably inside said headrail for lifting or lowering said blind body when said linking rod is actuated to rotate, the anti-reverse transmission apparatus comprising:

a base frame having a fixed axle;

an input shaft rotatably mounted to said base frame and rotatable by an external force;

an output shaft having a tubular shaft body rotatably sleeved onto said fixed axle of said base frame and coupled to said input shaft for rotation by said input shaft, the tubular shaft body of said output shaft having an opening in a periphery thereof;

a transmission shaft adapted to be axially coupled to said linking rod of the window blind for synchronous rotation, said transmission shaft having a tubular body sleeved onto the tubular shaft body of said output shaft, the tubular body of said transmission shaft having a protrusion projecting from an inside wall thereof and suspended in the opening of the tubular shaft body of said output shaft; and a spiral spring having a spiral spring body, a first end tip extended from a first end of said spiral body, and a second end tip extended from a second end of said spiral spring body, the spiral spring body of said spiral spring being fitted onto said fixed axle of said base frame within the tubular shaft body of said output shaft, the first and second end tips of said spiral spring being suspended in the opening of the tubular shaft body of said output shaft at two sides of the protrusion of said transmission shaft and respectively stopped at two opposite side edges of the opening of the tubular shaft body of said output shaft such that said output shaft pushes one end tip of said spiral spring to further radially expand said spiral spring body of said spiral spring when said output shaft is actuated by said input shaft to rotate; when said output shaft is immovable, rotating said transmission shaft causes said protrusion of said transmission shaft to push one end tip of said spiral spring and to further radially compress said spiral spring body of said spiral spring;

wherein said transmission shaft comprises a shaft member having said tubular body and a plurality of spaced hooks axially and eguiangularly extended from the periphery of the tubular body, and a coupling member being a circular box having an axially extended center through hole adapted to be coupled to said linking rod and a plurality of retaining notches respectively fastened to said hooks of said shaft member.

2. The anti-reverse transmission apparatus as claimed in claim 1, wherein said input shaft and said output shaft are respectively comprised of a bevel gear meshed with each other.

3. The anti-reverse transmission apparatus as claimed in claim 1, wherein said input shaft is comprised of a worm, and said output shaft is comprised of a worm gear meshed with said worm.

4. The anti-reverse transmission apparatus as claimed in claim 1, wherein the first and second end tips of said spiral spring are respectively radially extended from the two ends of the spiral spring body.

5. The anti-reverse transmission apparatus as claimed in claim 1, wherein said base frame is comprised of a main base element and a supplementary base element abutted against each other.

6. The anti-reverse transmission apparatus as claimed in claim 1, wherein said base frame comprises a cylindrical chamber, and a circular axle hole axially extended from said cylindrical chamber to a periphery of said base frame; said fixed axle is axially suspended in said cylindrical chamber and extended out of said base frame through said circular axle hole.

7. The anti-reverse transmission apparatus as claimed in claim 1, wherein said fixed axle has one end terminating in a neck and a crevice axially extended through said neck; said transmission shaft further comprises a bush located on one end of the tubular body of said transmission shaft and mounted on the neck of said fixed axle.

8. A window blind comprising:

a headrail;

a blind body suspended from said headrail and vertically movable between a received position and an extended position;

a linking rod horizontally rotatably mounted inside said headrail for free rotation to lift or lower said blind body;

an anti-reverse transmission apparatus comprising a base frame, an input shaft, an output shaft, a transmission shaft, and a spiral spring;

wherein said base frame is mounted in said headrail, having a horizontally extended fixed axle;

wherein said input shaft is rotatably mounted to said base frame and has a bottom side acing downwardly;

wherein said output shaft has a tubular shaft body rotatably sleeved onto said fixed axle of said base frame and coupled to said input shaft for rotation by said input shaft, the tubular body of said output shaft having an opening in a periphery thereof;

wherein said transmission shaft is axially coupled to said linking rod for synchronous rotation and has a tubular body sleeved onto the tubular shaft body of said output shaft, the tubular body of said transmission shaft having a protrusion projecting from an inside wall thereof and suspended in the opening of the tubular shaft body of said output shaft;

wherein said spiral spring has a spiral spring body, a first end tip extended from a first end of said spiral spring body, and a second end tip extended from a second end of said spiral spring body, the spiral spring body of said spiral spring being fitted onto said fixed axle of said base frame within the tubular shaft body of said output shaft, the first and second end tips of said spiral spring being suspended in the opening of the tubular shaft body of said output shaft at two sides of the protrusion of said transmission shaft and respectively stopped at two opposite side edges of the opening of the tubular shaft body of said output shaft such that said output shaft pushes one end tip of said spiral spring to further radially expand said spiral spring body of said spiral spring when said output shaft is actuated by said input shaft to rotate; when said output shaft is immovable, rotating said transmission shaft causes said protrusion of said transmission shaft to push one end tip of said spiral spring and to further radially compress said spiral spring body of said spiral spring; and a control rod coupled to the bottom side of the input shaft for rotating said input shaft by a user;

wherein said transmission shaft comprises a shaft member having said tubular body and a plurality of spaced hooks axially and eguiangularly extended from the periphery of the tubular body, and a coupling member being circular box having an axially extended center through hole adapted to be coupled to said linking rod and a plurality of retaining notches respectively fastened to said hooks of said shaft member.

9. The window blind as claimed in claim 8, wherein said input shaft and said output shaft are respectively comprised of a bevel gear meshed with each other.

10. The window blind as claimed in claim 8, wherein said input shaft is comprised of a worm, and said output shaft is comprised of a worm gear meshed with said worm.

11. The window blind as claimed in claim 8, wherein the first and second end tips of said spiral spring are respectively radially extended from the two ends of the spiral spring body.

12. The window blind as claimed in claim 8, wherein said base frame is comprised of a main base element and a supplementary base element abutted against each other.

13. The window blind as claimed in claim 8, wherein said base frame comprises a cylindrical chamber, and a circular axle hole axially extended from said cylindrical chamber to a periphery of said base frame; said fixed axle is axially suspended in said cylindrical chamber and extended out of said base frame through said circular axle hole.

14. The window blind as claimed in claim 8, wherein said fixed axle has one end terminating in a neck and a crevice axially extended through said neck; said transmission shaft further comprises a bush located on one end of the tubular body of said transmission shaft and mounted on the neck of said fixed axle.

15. The window blind as claimed in claim 8, wherein said anti-reverse transmission apparatus is installed in one end of said headrail; said control rod is suspended below said handrail, having a top end pivotally coupled to said bottom side of said input shaft.

16. The window blind as claimed in claim 8, wherein said control rod is detachably coupled to said bottom side of said input shaft.

* * * * *